US009835359B1

(12) United States Patent
Boros et al.

(10) Patent No.: US 9,835,359 B1
(45) Date of Patent: Dec. 5, 2017

(54) STACKABLE WATER HEATER APPARATUS

(71) Applicant: Rheem Manufacturing Company, Atlanta, GA (US)

(72) Inventors: Jozef Boros, Montgomery, AL (US); Hector J. Donastorg, Waverly, AL (US); Raheel A. Chaudhry, Montgomery, AL (US)

(73) Assignee: RHEEM MANUFACTURING COMPANY, Atlanta, GA (US)

( * ) Notice: Subject to any disclaimer, the term of this patent is extended or adjusted under 35 U.S.C. 154(b) by 0 days.

(21) Appl. No.: 14/963,017

(22) Filed: Dec. 8, 2015

Related U.S. Application Data

(63) Continuation of application No. 13/527,061, filed on Jun. 19, 2012, now Pat. No. 9,234,678.

(60) Provisional application No. 61/539,565, filed on Sep. 27, 2011.

(51) Int. Cl.

| | |
|---|---|
| ***F24H 1/18*** | (2006.01) |
| ***F24H 9/20*** | (2006.01) |
| ***F24H 1/00*** | (2006.01) |
| ***F24H 1/08*** | (2006.01) |
| ***F24H 1/20*** | (2006.01) |

(52) U.S. Cl.
CPC ..... *F24H 9/2021* (2013.01); *F24H 1/0018* (2013.01); *F24H 1/08* (2013.01); *F24H 1/182* (2013.01); *F24H 1/202* (2013.01)

(58) Field of Classification Search
None
See application file for complete search history.

(56) References Cited

U.S. PATENT DOCUMENTS

| | | | | |
|---|---|---|---|---|
| 1,925,849 | A * | 9/1933 | Sharp | H02G 3/283 220/3.2 |
| 2,157,910 | A | 5/1939 | McCormick | |
| 2,329,906 | A * | 9/1943 | Inglis | E01D 6/00 14/13 |
| 2,380,545 | A | 7/1945 | Pankow | |
| 2,441,086 | A * | 5/1948 | Stinson | H01Q 9/34 343/704 |
| 2,521,207 | A | 9/1950 | Eaton et al. | |
| 2,814,279 | A | 11/1957 | Thomas | |

(Continued)

FOREIGN PATENT DOCUMENTS

| | | |
|---|---|---|
| GB | 2376270 A | 12/2002 |
| GB | 2456881 | 8/2009 |

(Continued)

*Primary Examiner* — David Angwin
*Assistant Examiner* — Gyounghyun Bae
(74) *Attorney, Agent, or Firm* — King & Spalding LLP

(57) ABSTRACT

An electric water heating apparatus includes a first electric water heater having a first tank adapted to hold a quantity of water and a first electric heating structure disposed within the first tank. The electric water heating apparatus further includes a second electric water heater having a second tank adapted to hold a quantity of water; and a second electric heating structure disposed within the second tank. The electric water heating apparatus further includes a control unit that is in electrical communication with the first electric heating structure and second electric heating structure, the control unit configured to prevent both the first electric heating structure and the second electric heating structure from being simultaneously operable.

10 Claims, 5 Drawing Sheets

(56) References Cited

U.S. PATENT DOCUMENTS 2,834,865 A 5/1958 Coates
2,876,472 A 3/1959 Rousseau
3,175,075 A 3/1965 Nord et al.
2,987,604 A 6/1966 Swoyer
3,275,802 A 9/1966 Vandivere et al.
3,280,299 A 10/1966 Doniak
3,440,397 A 4/1969 Neer et al.
3,513,606 A * 5/1970 Jones ..... A47B 47/0016 211/182
3,666,918 A 5/1972 Clark et al.
3,766,358 A 10/1973 Gass-Erb
3,933,272 A 1/1976 Lamb et al.
3,992,607 A 11/1976 Jolin
4,111,798 A 9/1978 Peterson et al.
4,140,104 A 2/1979 Itagaki
4,207,866 A 6/1980 Boyd
4,324,207 A 4/1982 Leuthard
4,438,728 A 3/1984 Fracaro
4,534,321 A 8/1985 Rydborn
4,550,710 A 11/1985 McDonald, II
4,604,516 A 8/1986 Metz
4,681,257 A 7/1987 Turner
4,740,673 A * 4/1988 Robinson, Jr. ..... F24D 19/1054 219/510
4,914,275 A 4/1990 Kramer
5,023,926 A 6/1991 Arnold
5,317,670 A * 5/1994 Elia ..... F24D 19/1051 126/362.1
5,345,224 A * 9/1994 Brown ..... F24H 9/2007 340/605
5,417,329 A 5/1995 Whitman
5,438,914 A * 8/1995 Hohn ..... A47J 37/08 219/492
5,628,401 A 5/1997 Broeders
5,773,797 A 6/1998 Uemura
5,778,765 A * 7/1998 Klawuhn ..... A47J 31/46 99/290
5,848,222 A 12/1998 Jung
5,855,163 A 1/1999 DeMars
5,957,557 A 9/1999 Langer et al.
6,271,505 B1 8/2001 Henderson
6,275,655 B1 8/2001 Rixen
6,280,688 B1 8/2001 Motz
6,938,581 B2 9/2005 Neeser et al.
7,098,397 B2 * 8/2006 Lange ..... H02G 3/14 174/50
7,189,921 B2 * 3/2007 Andresen ..... H02G 3/16 174/50
8,169,296 B1 * 5/2012 Carlson ..... H04Q 3/68 333/101
8,366,014 B2 2/2013 Ene et al.
8,463,117 B2 6/2013 Yeung
2002/0186965 A1 12/2002 Zimmer
2004/0079749 A1 * 4/2004 Young ..... F24H 9/2021 219/486
2006/0010937 A1 1/2006 Kim
2007/0251468 A1 11/2007 Houle
2008/0308709 A1 * 12/2008 Tartan ..... D06F 29/00 248/678
2010/0021149 A1 1/2010 Mulder et al.
2010/0253082 A1 10/2010 Cotto-Rodriguez
2010/0290763 A1 * 11/2010 Boulay ..... F24H 1/201 392/451
2011/0233957 A1 * 9/2011 Sams ..... B60J 5/08 296/79
2012/0084972 A1 * 4/2012 Grady ..... H02G 3/086 29/825

FOREIGN PATENT DOCUMENTS

GB 2458826 10/2009
JP 2004-176992 6/2004
JP 2007-218521 8/2007
WO WO2009-079791 A1 7/2009

* cited by examiner

STACKABLE WATER HEATER APPARATUS

CROSS-REFERENCE TO RELATED APPLICATION

The present application is a continuation of U.S. patent application Ser. No. 13/527,061 entitled "Stackable Water Heater Apparatus," filed Jun. 19, 2012, which claims the benefit of the filing date of provisional U.S. Patent Application No. 61/539,565 filed Sep. 27, 2011, the entire disclosures of which are hereby incorporated by reference.

BACKGROUND OF THE INVENTION

The challenge of designing an energy efficient, economical residential electrical water heating system which effectively utilizes available building floor space has been heightened by the U.S. Department of Energy's recent amendment of their existing energy conservation standards for residential water heaters. In formulaic fashion, this amendment effectively requires that any residential water heater having a water storage capacity greater than fifty five gallons must incorporate therein a heat pump. While such incorporation is designed to increase the efficiency of an over-fifty five gallon water heater, installation with suitable airflow for all replacement applications may not be practical or cost effective. In view of this heightened efficiency requirement it would be desirable to provide multiple water heaters to meet the hot water requirements. It is to this goal that the present invention is primarily directed.

In representatively illustrated embodiments thereof, this invention provides specially designed water heater apparatus with features that allow for an installation comprising upper and lower vertically stacked electric individual water heaters served by a single electrical branch circuit. Each of the upper and lower water heaters has a water storage capacity not exceeding 55 gallons, and the combined water storage capacity of the upper and lower water heaters is greater than 55 gallons. The electric heating elements of the two water heaters are non-simultaneously controlled so that at no time do the two water heaters heat water at the same time.

DETAILED DESCRIPTION

Figure 1:
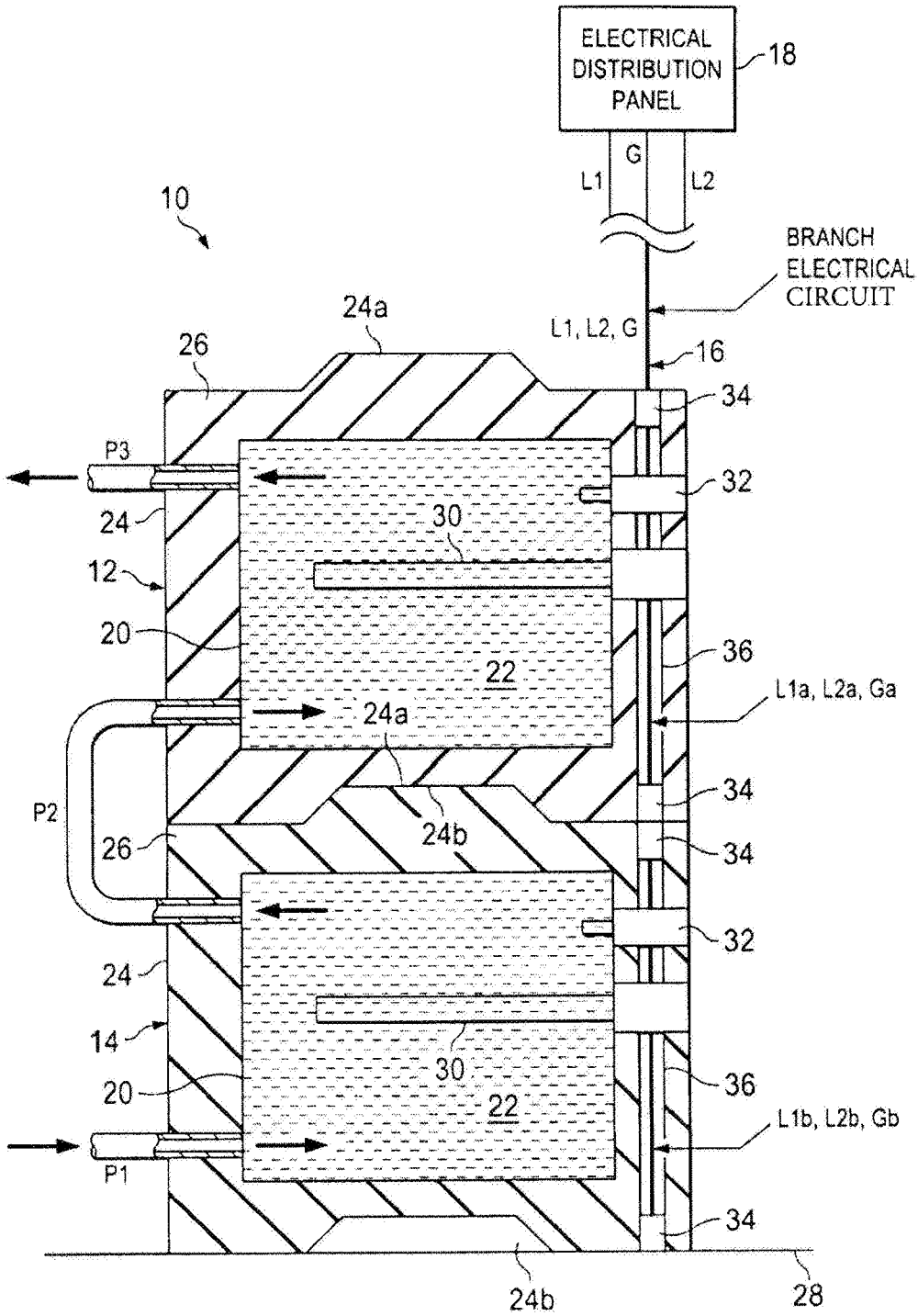
FIG. 1 is a schematic cross-sectional view through two vertically stacked electric water heaters embodying principles of the present, invention and served by a single electrical branch circuit.

Schematically depicted in FIG. 1 is a specially designed electric water heater assembly 10 which comprises vertically stacked upper and lower electric water heaters 12 and 14 and is served by a single branch electrical circuit portion 16 of an electrical distribution panel 18. Branch circuit 16 comprises two power wires or leads L1 and L2, and a ground wire or lead G. Each of the water heaters 12 and 14 has a metal tank 20 adapted to hold a quantity of water 22 to be heated. According to an aspect of the present invention, the volume of each of the tanks 20 is no more than fifty five gallons, and the total volume of the two tanks 20 is greater than fifty five gallons. As subsequently described herein, the upper and lower electric water heaters 12 and 14 are non-simultaneously controlled in a manner such that neither water heater operates while the other one is performing its water heating function. Thus, the electrical branch circuit 16 need only be sized to accommodate one of the two water heaters 12 and 14 (the larger one if they do not have equal water heating capacities). Importantly, this combination of design aspects in the present invention adheres to both the letter and spirit of the DOE energy efficiency standard amendment. Specifically, neither of the water heaters has a water storage capacity exceeding fifty five gallons, and the two stored water quantities (which together exceed fifty five gallons) are never heated at the same time.

Still referring to FIG. 1, each the tanks 20 is enclosed within an outwardly spaced metal jacket 24, with suitable insulation 26 being disposed within the space between the jacket 24 and the tank 20. The upper end of each jacket 24 has a centrally disposed upward projection 24*a*, and the lower end of each jacket 24 has a complementarily shaped central recess 24*b*. The upper and lower water heaters 12 and 14 are vertically stacked as shown in FIG. 1 by placing the lower water heater 14 on a suitable horizontal support surface such as a floor 28 and then placing the upper water heater 12 atop the lower water heater 14 in a manner such that the upper projection 24*a* of the lower water heater 14 is interlockingly received in the lower recess 24*b* of the upper water heater 12. This horizontally aligns and stabilizes the upper and lower water heaters 12 and 14.

While the illustrated upper and lower water heaters 12 and 14 are representatively depicted as being identical, it will be readily apparent to those of ordinary skill in this particular art that they could be of different storage capacities, heating capacities and/or different physical sizes if desired without departing from principles of the present invention. For example, the upper water heater 12 could be of a smaller diameter than the lower water heater 14, with the central vertical axes of the two water heaters being horizontally offset from one another. It should be noted that the vertical stacking of the two water heaters 12 and 14 advantageously reduces the footprint of the overall water heater assembly 10 compared to, for example, (1) placing both of the water heaters 12,14 on the floor 28, or (2) using a single water heater (having the same total water storage and heating capacity as the stacked water heater assembly 10).

Each of the upper and lower water heaters 12 and 14 has a resistance type electrical heating element 30 horizontally extending into the interior of its tank 20 and being controlled by a conventional combination high limit/operating thermostat 32. As indicated by the flow arrows in FIG. 1, during operation of the assembly 10, water flows into the lower tank 20 via an inlet pipe P1, from the lower tank 20 into the upper tank 20 via a transfer pipe P2, and then out of the upper tank 20 through an outlet pipe P3. As will be readily appreciated by those of skill in this particular art, the plumbing connections between the two water heaters may be accomplished to provide either a serial flow connection therebetween (as illustratively depicted in FIG. 1) or a parallel flow connection between the two water heaters.

Circumferentially aligned junction boxes 34 are disposed in peripheral portions of the upper and lower ends of each of the upper and lower water heaters 12 and 14. Extending downwardly through the insulation 26 between the two junction boxes 34 on each water heater 12 and 14 is a vertical wiring passage 36. The upper water heater 12 is stacked atop the lower water heater 14 in a manner such that, as schematically depicted in FIG. 1, the junction boxes 34 and the wiring passages 36 are circumferentially aligned with one another.

Figure 2:
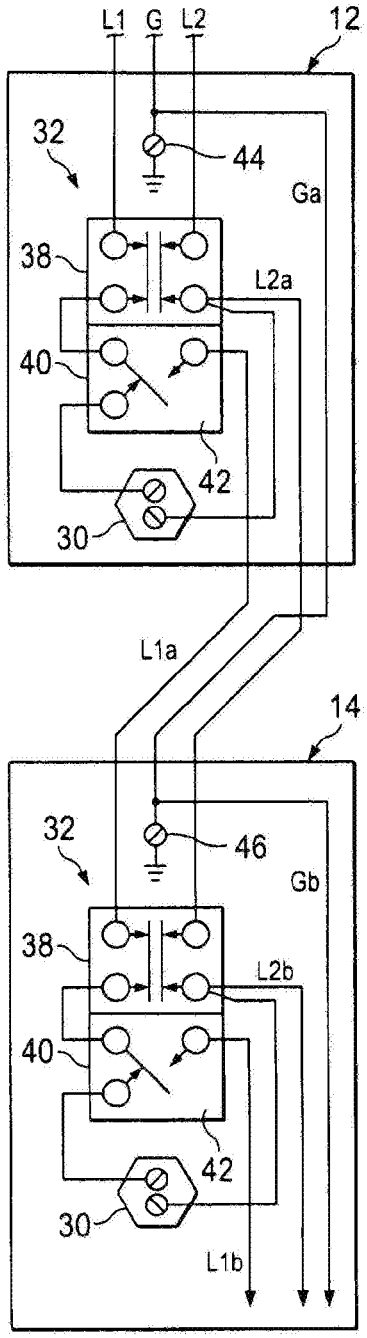
FIG. 2 is a schematic electrical circuit diagram of the stacked water heaters.

As subsequently described in more detail herein, power and ground wiring from the single branch electrical circuit 16 is passed downwardly through the circumferentially aligned wiring passages 36 and is operatively connected to the heating elements 30 and the thermostats 32 in a manner such that the heating elements are non-simultaneously controlled. With reference now to FIG. 2, each of the conventional thermostats 32 has an upper high limit section 38 and a lower operating section 40. Sections 38 and 40 have the indicated wiring terminals 1-4, and each operating section 40 is provided with the indicated single pole, double throw switch 42. Each electric heating element 30 is electrically coupled to its associated switch terminals 2 and 4 as indicated.

According to a feature of the present invention, the two thermostats 32 are electrically coupled in a manner providing the non-simultaneous control of the two heating elements 30 so that only one is operable at a given time. Specifically, as schematically depicted in FIG. 2, power leads L1 and L2 are respectively connected to terminals 1 and 3 of the high limit section 38 of the upper thermostat 32, and the ground lead G is connected to the grounding terminal 44 of the upper water heater 12. Operative control coupling of the upper and lower water heaters 12 and 14 is effected utilizing supplemental power leads L1*a*,L2*a* and a supplemental grounding lead Ga. Lead L1*a* is interconnected between the thermostat operating section terminal 4 of the upper water heater 12 and the thermostat high limit section terminal 1 of the lower water heater 14. Lead L2*a* is interconnected between the thermostat high limit section terminal 4 of the upper water heater 12 and the thermostat operating section terminal 3 of the lower water heater 14. Lead Ga is interconnected between lead G and the grounding terminal 46 of the lower water heater 14.

By tracing the circuitry in FIG. 2 it can be seen that with the upper thermostat switch 32 interconnecting its associated thermostat operating section terminals 1 and 2 current flow through the upper heating element 30 to satisfy the water heating demand of the upper water heater 12 is permitted, but simultaneous current flow through the lower heating element 30 is precluded by the circuit opening between terminals 1 and 4 of the operating section 40 of the upper thermostat 32. Conversely, when the water heating demand of the upper water heater 12 is satisfied, the upper switch 32 disconnects the terminals 1 and 2 of the operating section 40 of the upper thermostat 32 and electrically connects the terminals 1 and 4 of the operating section 40 of the upper thermostat 32, thereby permitting current flow through the lower heating element 30 and blocking current flow through the upper heating element 30. Accordingly, neither heating element 30 can receive a current throughflow when the other heating element 30 has electrical current being supplied thereto.

Representatively, but not by way of limitation, the water heaters schematically depicted in FIGS. 1 and 2 are of substantially identical size and construction, with the lower water heater 14 having capped-off power and ground leads L1*b*, L2*b* and Gb connected as shown to its heating element 30 and thermostat 40. As will be appreciated, these leads may be operatively connected to the thermostat and heating element of another water heater upon which the water heater 14 is to be stacked. Water heater 12 would, as manufactured, also have these capped off leads which may be operatively coupled to a water heater upon which it could be stacked. In the stacked water heater assembly shown in FIGS. 1 and 2, the lead sets L1, L2 and G, L1*a*, L2*a* and Ga, and L1*b*, L2*b* and Gb may be conveniently run downwardly through the aligned wiring passages 36 as shown in FIG. 1.

Figure 3:
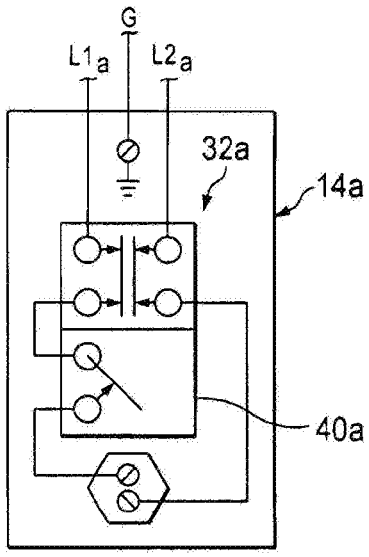
FIG. 3 is a schematic electrical circuit diagram of a single element electric water heater useable in place of the lower water heater in FIG. 1.

An alternate bottom electric water heater embodiment 14*a* is shown in FIG. 3. Water heater 14*a* is identical in construction to the previously described water heater 14 with the exceptions that it is not provided with the bottom interconnecting leads L1*b*, L2*b* and Gb, and its thermostat 32*a* does not utilize a terminal 4 on its operating section 40*a*.

Figure 4:
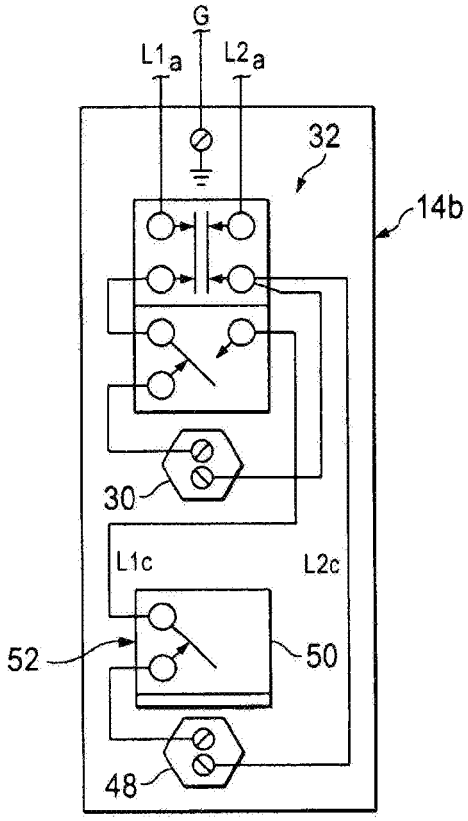
FIG. 4 is a schematic electrical circuit diagram of a double element electric heater useable in place of the lower water heater in FIG. 1.

A second alternate bottom electric water heater embodiment 14*b* is shown in FIG. 4. Water heater 14*b* has upper and lower electric heating elements 30 and 48 which are respectively controlled by a conventional combination high limit/operating thermostat 32 and a thermostat 50 having a single pole single throw switch 52. The upper thermostat 32 and heating element 30 are operatively interconnected as shown by power leads L1*c* and L2*c*, and the upper thermostat 32 is connected to the thermostat 32 of the upper water heater 12 (see FIG. 2) by the leads L1*a*, L2*a* and Ga. As can be seen this wiring connection provides non-simultaneous control of the water heaters 12 and 14*b*, and further prevents non-simultaneous operation of the heating elements 32 and 48 in the lower water heater 14*b*.

Figure 5:
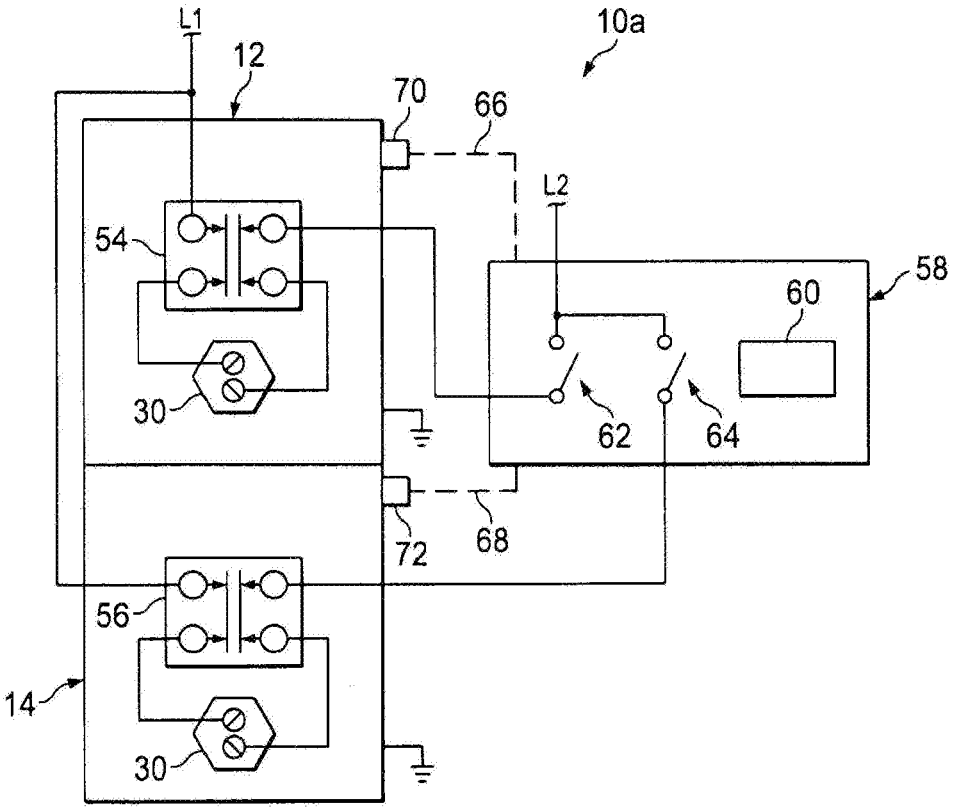
FIG. 5 is a schematic electrical circuit diagram of first and second vertically stacked single element electric water heaters which are electronically controlled and served by a single electrical branch circuit.

Schematically illustrated in FIG. 5 is an alternate embodiment 10*a* of the previously described stacked water heater assembly 10. In assembly 10*a* the previously described combination high limit/operating thermostats 32 shown in FIG. 1 are replaced by high limit switch structures 54 and 56 respectively disposed within the tank portions of the upper and lower water heaters 12 and 14, and the switching capability useable to provide non-simultaneous control of the upper and lower water heaters 12 and 14 is provided by an electronic control panel 58 incorporating therein a suitable preprogrammed microprocessor 60. Power lead L1 is connected to the upper and lower high limits switches 56, and the heating elements 30 are also connected as shown to the high limit switches 54 and 56. Further, the high limit switches 54 and 56 are respectively connected as illustrated to two control panel switches 62 and 64 which are also electrically connected as shown to the power lead L2. Switches 62 and 64 may alternatively be relays, or other electronic devices, that can switch the resistive load of the heating elements. In response to temperature signals 66 and 68 respectively received from upper and lower tank water temperature sensors 70 and 72, the control panel 58 electronically controls the switches 62 and 64 in a manner providing non-simultaneous control of the upper and lower water heaters 12 and 14 shown in FIG. 5.

Figure 6:
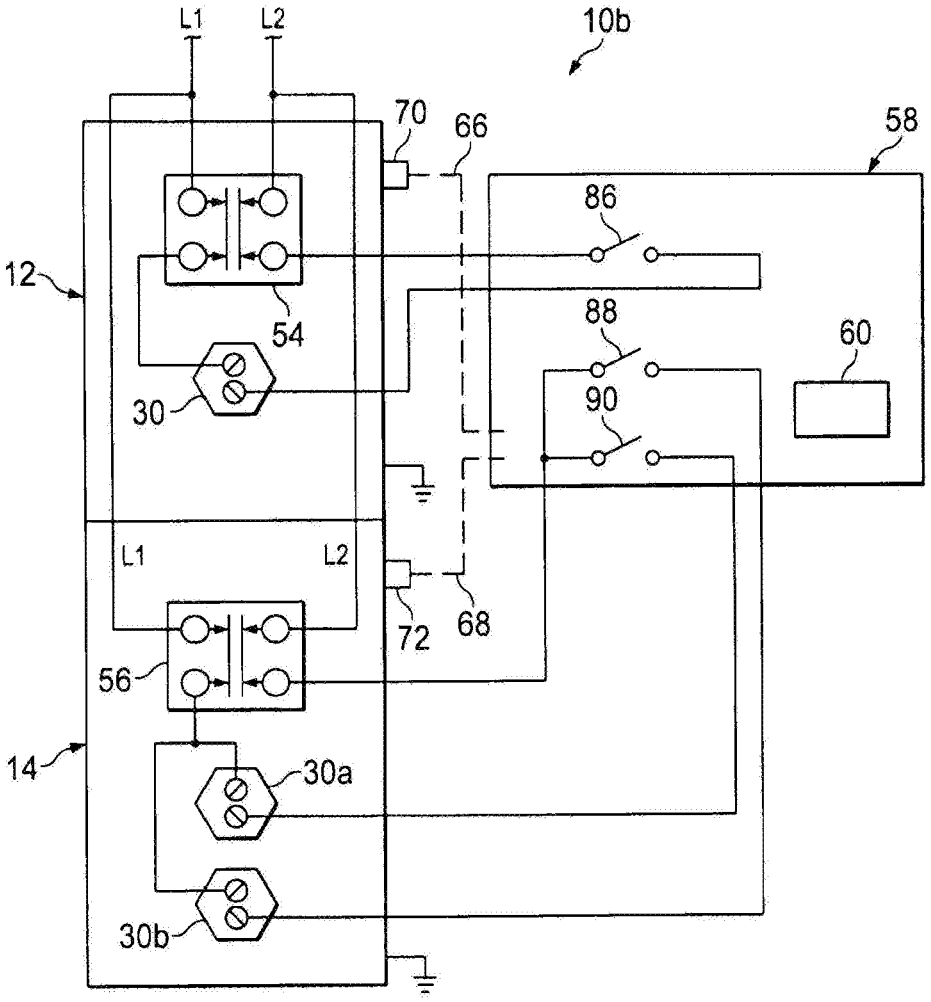
FIG. 6 is a schematic electrical circuit diagram of vertically stacked single element and double element electric water heaters which are electronically controlled and served by a single electrical branch circuit.

A second alternate embodiment 10*b* of the water heater assembly 10 is schematically shown in FIG. 6 and is substantially identical to the previously described assembly 10*a* in FIG. 5 with the primary exceptions that the lower water heater 14 is provided with upper and lower heating elements 30*a* and 30*b* coupled to their associated high limit switch 56 as shown, and three switches 86, 88 and 90 are included in the control panel 58 and coupled to the high limit switches 54,56 and the electric heating elements 30, 30*a* and 30*b* as shown. Switches 86,88 and 90 may alternatively be relays, or other electronic devices, that can switch the resistive load of the heating elements. In response to temperature signals 66 and 68 respectively received from upper and lower tank water temperature sensors 70 and 72, the control panel 58 electronically controls the switches 86, 88 and 90 in a manner providing non-simultaneous control of the upper and lower water heaters 12 and 14, and further providing non-simultaneous energization of the lower water heater heating elements 30*a* and 30*b*.

Figure 7:
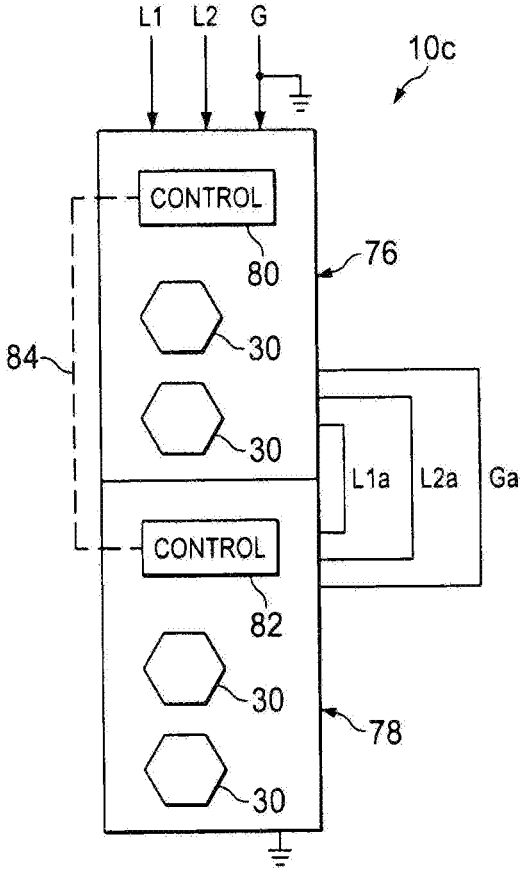
FIG. 7 schematically depicts an alternative electronic control scheme for vertically stacked water heaters that are served by a single electrical branch circuit.

Shown in FIG. 7 is a third alternate embodiment 10*c* of the previously described stacked water heater assembly 10. Embodiment 10*c*, by way of non-limiting example, comprises vertically stacked upper and lower water heaters 76 and 78 electrically coupled by the previously described lead sets L1, L2 and G, and L1*a*, L2*a* and Ga, and each having, dual electrical resistance heaters 30 extending through the interiors of their tank portions. The upper and lower water heaters 76 and 78 are non-simultaneously controlled by upper and lower control structures 80 and 82 which may communicate with one another via a communication line 84. Representatively, the upper control structure 80 may be a master unit, and the lower control structure 82 may be a slave unit, with the master unit 80 having the capability of sensing whether the upper and lower water heaters 76 and 78 have single or multiple heating elements and responsively adjusting the control functions and sequences associated with the operative control of the upper and lower water heaters 76 and 78. Master unit 80 also determines which element to turn on in a way that only one element is turned on at any given time.

The foregoing detailed description is to be clearly understood as being given by way of illustration and example only, the spirit and scope of the present invention being limited solely by the appended claims.

What is claimed is:

1. An electric water heating system comprising:

a first individually separable electric water heater comprising:

a first tank sized to hold a first quantity of water less than 55 gallons;

a first electric heating structure disposed within the first tank and adapted to heat the first quantity of water; and a first control circuit in electrical communication with the first electric heating structure, the first control circuit comprising a first temperature sensing element configured to detect a temperature of the first quantity of water;

a second individually separable electric water heater configured to have the first individually separable electric water heater mounted thereon, the second individually separable electric water heater comprising:

a second tank sized to hold a second quantity of water less than 55 gallons, the first and second tanks being sized so that the combined first and second quantities of water are greater than 55 gallons;

a second electric heating structure disposed within the second tank and adapted to heat the second quantity of water; and a second control circuit in electrical communication with the first control circuit and the second electric heating structure, the second control circuit comprising a second temperature sensing element configured to detect a temperature of the second quantity of water;

a first jacket structure outwardly circumscribing the first tank and forming a first insulation space between the first jacket structure and the first tank;

a second jacket structure outwardly circumscribing the second tank and forming a second insulation space between the second jacket structure and the second tank; and a first insulation material disposed in the first insulation space and a second insulation material disposed in the second insulation space, wherein the first individually separable electric water heater includes a first upper junction box and a first lower junction box, wherein the second individually separable electric water heater includes a second upper junction box and a second lower junction box, wherein the first control circuit is connected in series with the second control circuit, and wherein the first upper junction box is configured to receive power from a branch circuit and supply the power to the first control circuit and, via the first lower junction box and the second upper junction box, to the second control circuit connected in series such that the first control circuit and the second control circuit form a control unit that is configured to prevent both the first electric heating structure and the second electric heating structure from being simultaneously operable.

2. The system of claim 1, further comprising:

a first wiring passage extending through the first insulation material between the first upper junction box and the first lower junction box; and a second wiring passage extending through the second insulation material between the second upper junction box and the second lower junction box.

3. The system of claim 1, wherein the first control circuit includes a first three-way switch and the second control circuit includes a second three-way switch.

4. The system of claim 3, wherein the first three-way switch comprises a first position that completes an electrical circuit passing through the first electric heating structure and a second position that bypasses the first electric heating structure and connects to the second three-way switch of the second control circuit.

5. The system of claim 4, wherein the second three-way switch comprises a first position that completes an electrical circuit passing through the second electric heating structure only when the first three-way switch is in the second position.

6. The system of claim 5, wherein the second three-way switch comprises a second position that bypasses the second electric structure.

7. An electric water heating system comprising:

a first individually separable electric water heater comprising:

a first tank sized to hold a first quantity of water less than 55 gallons;

a first electric heating structure disposed within the first tank and adapted to heat the first quantity of water;

a first control circuit in electrical communication with the first electric heating structure, the first control circuit comprising a first temperature sensing element configured to detect a temperature of the first quantity of water;

a second individually separable electric water heater configured to have the first individually separable electric water heater mounted thereon, the second individually separable electric water heater comprising:

a second tank sized to hold a second quantity of water less than 55 gallons, the first and second tanks being sized so that the combined first and second quantities of water are greater than 55 gallons;

a second electric heating structure disposed within the second tank and adapted to heat the second quantity of water; and a second control circuit in electrical communication with the first control circuit and the second electric heating structure, the second control circuit comprising a second temperature sensing element configured to detect a temperature of the second quantity of water;

wherein the first control circuit and the second control circuit form a control unit that is configured to prevent both the first electric heating structure and the second electric heating structure from being simultaneously operable, and wherein the first individually separable electric water heater includes a first upper junction box and a first lower junction box, wherein the second individually separable electric water heater includes a second upper junction box and a second lower junction box, wherein the first control circuit is connected in series with the second control circuit, and wherein the first upper junction box is configured to receive power from a branch circuit and supply the power to the first control circuit and, via the first lower junction box and the second upper junction box, to the second control circuit connected in series.

8. The system of claim 7, wherein the first control circuit includes a first three-way switch and the second control circuit includes a second three-way switch.

9. The system of claim 8, wherein the first three-way switch comprises a first position that completes an electrical circuit passing through the first electric heating structure and a second position that bypasses the first electric heating structure and connects to the second three-way switch of the second control circuit.

10. The system of claim 9, wherein the second three-way switch comprises a first position that completes an electrical circuit passing through the second electric heating structure only when the first three-way switch is in the second position.

* * * * *